US006896265B1

(12) United States Patent
Schlumbrecht

(10) Patent No.: US 6,896,265 B1
(45) Date of Patent: May 24, 2005

(54) CASINO FLOP POKER

(76) Inventor: T. Christian A. Schlumbrecht, 5521 Elysian Fields, New Orleans, LA (US) 70122

( * ) Notice: Subject to any disclaimer, the term of this patent is extended or adjusted under 35 U.S.C. 154(b) by 0 days.

(21) Appl. No.: 10/667,106

(22) Filed: Sep. 19, 2003

Related U.S. Application Data

(63) Continuation-in-part of application No. 10/224,695, filed on Aug. 22, 2002, now abandoned.

(51) Int. Cl.[7] ..... A63F 1/00
(52) U.S. Cl. ..... 273/292
(58) Field of Search ..... 273/274, 292; 463/13

(56) References Cited

U.S. PATENT DOCUMENTS

| | | | | |
|---|---|---|---|---|
| 4,836,553 | A | | 6/1989 | Suttle et al. |
| 4,861,041 | A | | 8/1989 | Jones et al. |
| 4,948,134 | A | | 8/1990 | Suttle et al. |
| 5,078,405 | A | | 1/1992 | Jones et al. |
| 5,288,081 | A | | 2/1994 | Breeding |
| 5,382,025 | A | | 1/1995 | Sklansky et al. |
| 5,417,430 | A | | 5/1995 | Breeding |
| 5,494,295 | A | | 2/1996 | Potter et al. |
| 5,810,354 | A | | 9/1998 | Banyai |
| 5,901,958 | A | | 5/1999 | Andrews |
| 5,951,012 | A | | 9/1999 | Feola |
| 5,964,464 | A | | 10/1999 | Jones |
| 5,975,529 | A | | 11/1999 | de Keller |
| 6,196,547 | B1 | | 3/2001 | Pascal et al. |
| 6,206,373 | B1 | | 3/2001 | Garrod |
| 6,279,910 | B1 | | 8/2001 | de Keller |
| 6,283,474 | B1 | | 9/2001 | de Keller |
| 6,332,614 | B1 | * | 12/2001 | Hesse ..... 273/292 |
| 6,375,189 | B1 | | 4/2002 | Jones |
| 6,379,245 | B2 | | 4/2002 | De Keller |
| 6,402,150 | B1 | | 6/2002 | Jones |
| 6,435,509 | B2 | | 8/2002 | Wichinsky et al. |
| 6,443,455 | B1 | | 9/2002 | Webb |
| 6,467,771 | B1 | * | 10/2002 | deKeller ..... 273/274 |
| 6,474,646 | B1 | | 11/2002 | Webb |
| 6,503,145 | B1 | | 1/2003 | Webb |
| 6,536,768 | B2 | | 3/2003 | Caputo |
| 6,561,897 | B1 | | 5/2003 | Bourbour et al. |
| 6,575,464 | B1 | * | 6/2003 | Fertitta et al. ..... 273/274 |
| 2002/0008356 | A1 | | 1/2002 | de Keller |

* cited by examiner

*Primary Examiner*—Kurt Fernstrom
(74) *Attorney, Agent, or Firm*—Garvey, Smith, Nehrbass & Doody, L.L.C.; Brett A. North

(57) ABSTRACT

A casino game comprising one or more decks of standard playing cards and a layout which designates a first area for the placing of community cards and a second area composed of a plurality of betting areas. The object of the game being to make a good poker hand of 5 cards being composed of players' individual cards in conjunction with community cards. A further object of the game is to win the "Pot" bets by holding the highest poker hand. The preferred game apparatus includes a single deck of standard playing cards and a layout that provides betting areas.

8 Claims, 2 Drawing Sheets

CASINO FLOP POKER

CROSS-REFERENCE TO RELATED APPLICATIONS

This is a continuation-in-part of U.S. patent application Ser. No. 10/224,695, filed August 22, 2002, now abandoned which is incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND

The present invention relates to methods for playing a casino game in the nature of poker using one or more decks of conventional playing cards. More particularly, the present invention relates to a method for playing a casino wagering game which is a variation of five-card stud poker.

Poker is a popular game throughout the world. It combines principles of card games known for centuries in Europe but in its present form it is distinctly of American origin. There are numerous forms of Poker and the main divisions are: Draw Poker, in which all of a player's cards are unknown to his opponents and Stud Poker, in which some of the player's cards are face up and others face down.

Within the above two broad categories numerous variations exist with "Holdem" or "Texas Holdem" being a popular example. In "Holdem" each player makes an ante wager and is dealt two cards face down. After a betting interval three communal cards are dealt face up. A second betting interval follows and the dealer then turns up one more communal card. Another betting round follows after which the dealer turns up the final communal card and the player with the highest Poker ranked hand assembled from their own cards and the five communal cards wins the pot.

In modern casinos Poker takes one of three forms: live or cardroom Poker where players compete against one another but the games are controlled and supervised by a house dealer who removes a house levy either in the form of a participation fee or as a percentage of winning hands; electronic video machines offering various forms of Poker; and Poker played as a "bankers game" either where the game involves players in contest with the dealer's hand or where the object is for the players to obtain a hand based on hierarchical Poker rankings. In both versions of Banker games the house enjoys a favorable advantage based on a pay table that is structured in such a way that the pay-offs are not based on the true mathematical odds, or rules of play so structured that the house has a favorable edge.

The growth in casinos has prompted the introduction of new games and variations to established games and numerous patents have been granted in this field. For example, in U.S. Pat. Nos. 4,836,553 and 4,948,134 (Suttle et al.) a casino type Poker game is disclosed in which players each play against a dealer (a banked game). If a player wins, he receives a bonus payment depending on the Poker rank of his hand.

Various other patents disclose further variations to traditional forms of Poker. Sklansky U.S. Pat. No. 5,382,025 discloses a modification of Texas Holdem whereby players do not compete against one another and whereby players have the opportunity to select their two card hand from a plurality of hands dealt face-up. Breeding U.S. Pat. No. 5,417,430 discloses a Poker banker game in which the players place three bets at the outset but as the game unfolds the players are given the option of withdrawing two of their wagers. Potter et al U.S. Pat. No. 5,494,295 disclose an invention which provides a method whereby a plurality of hand ranking rules can be utilized within a single type wagering game.

U.S. Pat. No. 4,836,553 and U.S. Pat. No. 4,861,041 (both to Jones et al) disclose variations which are collectively referred to as Caribbean Studs poker. In the preferred method of play described in the '553 patent, the game commences with each player placing a preliminary bet ("ante") at a designated location on a table layout. The house dealer deals five cards to each player and to himself, all face down except for one card in the hand of the dealer. Having viewed his hand and assessed the chances, each player can elect to retire from the round at that point (to "fold") in which event the player forfeits his amount of the ante to the house. The alternative is for the player to make an additional bet—typically prescribed by house rules to be double the amount originally anted—whereupon the dealer reveals his entire hand. Provided that the dealer's hand has a poker value of at least Ace-King, the game progresses with the dealer comparing his hand to that of each pair and paying or collecting bets as appropriate. Poker hands of two pair or better are rewarded by payment of better than even odds on such hand of a winning player.

U.S. Pat. No. 4,861,041 discloses the optional super addition to Caribbean Stud™ of a "progressive jackpot" in which a player may at his option participates in that jackpot by making an additional jackpot wager of some predetermined amount, e.g. a playing token. The jackpot wagers submitted by all players are cumulated. The jackpot is paid out in whole or in part from time to time on the strength of the poker hand held by the winning jackpot bettor. Insofar as the amounts of the jackpot not won in a hand are carried over to the next, the jackpot is "progressive". The '041 patent and Jones et al U.S. Pat. No. 5,078,405 disclose totalizing apparatus including slots in which each player may deposit a gaming token towards the jackpot component, if desired and means for increasing or decreasing the jackpot meter as money is paid into or out of the jackpot. These two patents are incorporated herein by reference for their teaching of token-operated apparatus for keeping a running jackpot total.

In another variation of five-card stud poker for casino play, disclosed in U.S. Pat. No. 5,901,858 (Andrews), is carried out with one or more "royal" decks of twenty cards each—namely the 10's and face cards of each suit. Unlike Caribbean Stud™ described above, only three cards are dealt face down to each player and only two to the house dealer. One of the dealer's cards is displayed as a face-up community card for consideration by each player for use as the fourth card of the player's ultimate five-card poker hand. Having viewed his three cards and the community card, each player has the option of either standing on the "bet" wager which he initially placed on the game table or, if optimistic, placing a second (equivalent) "additional" wager on the "play" position and turning the three cards of the hand face up. That done, the dealer turns up the second of dealer's two cards as a second community card. The negative five-card poker hand of all players are evaluated and payouts are made according to a payout table.

A different game, commonly referred to as "Let it Ride" is described in U.S. Pat. No. 5,288,081 (Breeding). Each player must place down three equal bets, whereupon the dealer deals three cards to each player and to the dealer, but then discards out of play ("burns") one of the dealer's three cards, sight unseen, leaving the dealer with only two cards. Alternatively, the dealer may simply deal three cards down to each player and refrain from dealing himself a third card. At that point, each player must decide whether to take back the first of his three bets or else to "let it ride." The dealer then turns up one of the two community cards so that each player, now in effect in possession of four cards of the ultimate five-card hand, is put to a decision whether to withdraw the second bet from the table or to let that bet ride. The third bet is not retrievable When dealer then turns over the second and last of his cards, play comes to an end, the players show their cards, and all bets still on the table are resolved and distributed according to the poker ranking of each bettor's hand.

In various of these games the participants are provided the option of discarding some or all of the cards which they were originally dealt. Such option can slow down the game causing it to lose momentum. There is a need for a new game where players both compete against one another and against the house and where the final result is delivered quickly to maximize the momentum of games played one after another.

It is an object of the present invention to provide a casino variation of five-card stud which allows players to bet against the house and each other while quickly revealing the results of each game.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF SUMMARY

The apparatus of the present invention solves the problems confronted in the art in a simple and straightforward manner. What is provided is a new card game of Flop Poker where players compete against the house and each other providing the opportunity to increase their wager against the house during play and providing a quick revelation of the final game result.

Flop Poker is based on the game of poker and comprises an apparatus for playing a casino game wherein elements of skill and chance are blended. The apparatus consists of a playing surface/layout (cloth, table top or game board) and a result selector in the form of a single deck of conventional playing cards, as is commonly used in casinos; the layout being marked out with a first area constituted by at least two or more areas, in the form of rectangles, circles, squares or other geometric shapes, situated directly in front of the dealer, such demarcated areas being for the placing of community cards numbering from two to five.

A second area on the layout designates betting areas for the reception of players' chips. Indicia for different bets, situated in the front of each player, signify the type of wagers the players make in the course of a round of the game. The betting areas may appear in the form of geometric shapes.

The method includes one or more players making wagers against the house and against the other players. Players are given the opportunity to increase their initial wager against the house. If a player's hand is a designated winning outcome, the player receives a payoff based upon his wager(s) against the house and if the outcome is a losing outcome the player's wager(s) against the house are lost. At the same time the player's hand is compared against all the other hands in the game and the best hand wins all wagers against the other players.

In Flop Poker the object of the game is twofold:

a) to make a good poker hand and b) to win the various bets.

In the case of "a" the house payout schedule lists a series of poker rankings with corresponding pay-offs and in the case of "b" the player with the highest poker hand showing wins the "Pot" bets. The "Pot" bet is a bet solely between the players and not a wager played against the house.

The game is played on a blackjack style table with a single dealer. One or more decks of standard playing cards can be used, the preferred embodiment being one. The player opening the betting can be rotated for each game. The game is played with chips/counters of various denominations.

In a live table game format, the players each make an initial "ante" wager and a "Pot" wager. The dealer deals cards to the players and a community hand to be shared by all players to make the best five card Poker hand. The dealing may be according to any one of the following formats of Table 1:

TABLE 1

| Format | Player's Cards | Community Cards |
|---|---|---|
| 1 | 3 cards, face down | At least 3 cards face down |
| 2 | 3 cards, face down | At least 3 cards, at least one face up |

In a preferred embodiment, at the start of each game all players can place bets of equal value in their respective "Ante" positions and also place bets of a equal value in their respective "Pot" positions. "Ante" bets are against the house and pot bets are against other players. Players can be dealt three cards and the dealer receives three cards (all three of which are face down). The three dealer's cards are community cards, referred to as the "flop" and complete each player's hand. At this stage the players at least know the identity of their respective three cards and have the option of continuing against the house and making a "Flop" bet based on the community cards in front of the dealer.

If a player decides not to make a "Flop" bet, he quits the game against the house surrendering his "Ante" bet, but continues the game against the other players based on his original "Pot" bet. If all players decide to not make "Flop" bets, they will each surrender their respective "Ante" bets, but continue against the other players for the combined "Pot" bets. At this point the dealer will reveal the three "flop" community cards and each player has the ability to use two of the three community cards to make the best five card hand. The player with the best five card hand wins all combined original "pot" bets. In the event of players holding identical hands the combined "Pot" bets can be shared by the winning players.

If a player decides to make a "flop" bet, he places his "flop" bet in the "flop" position. This player is now playing against both the house and the other players. Against the house this player is placing both his "ante" bet and his "flop" bet. Against the other players this player is placing his "pot" bet. At this point the dealer will reveal the three "flop" community cards and each player reveals his cards. Each player has the ability to use two of the three community cards to make the best possible five card hand. No matter how many cards constitute community cards or how many cards are dealt to each player, the players select five cards to make up their hands. Each player who continued against the house by placing a "flop" bet, will have his best five card hand compared to the house table winning schedule corresponding pay-offs/odds. Each player having a losing hand against the house will forfeit his "ante" and "flop" bets. Each player having a winning hand against the house will receive even money for that player's "ante" bet and will receive pay table house odds for that player's "flop" bet. Once all casino wagers have been settled for each player, the Dealer can find the highest value five card poker hand among all players and award that player all combined original "pot" bets. In the event of players holding identical hands the combined "Pot" bets can be shared by the winning players.

The drawings constitute a part of this specification and include exemplary embodiments to the invention, which may be embodied in various forms.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

The cards used in the game can be conventional playing cards divided into four sets of thirteen cards per set and each set constitutes a suit identified by separate indicia in the form of hearts, spades, diamonds and clubs. Each set in turn has nine cards bearing the numerals 2 to 10 and four court cards represented by either the letters A, K, Q & J or the titles Ace, King, Queen and Jack or pictorial representations or symbols thereof. Designs of modern court cards may differ but all are generally stylizations of stylizations and have their roots in the Tarot pack of medieval times.

Figure 1:
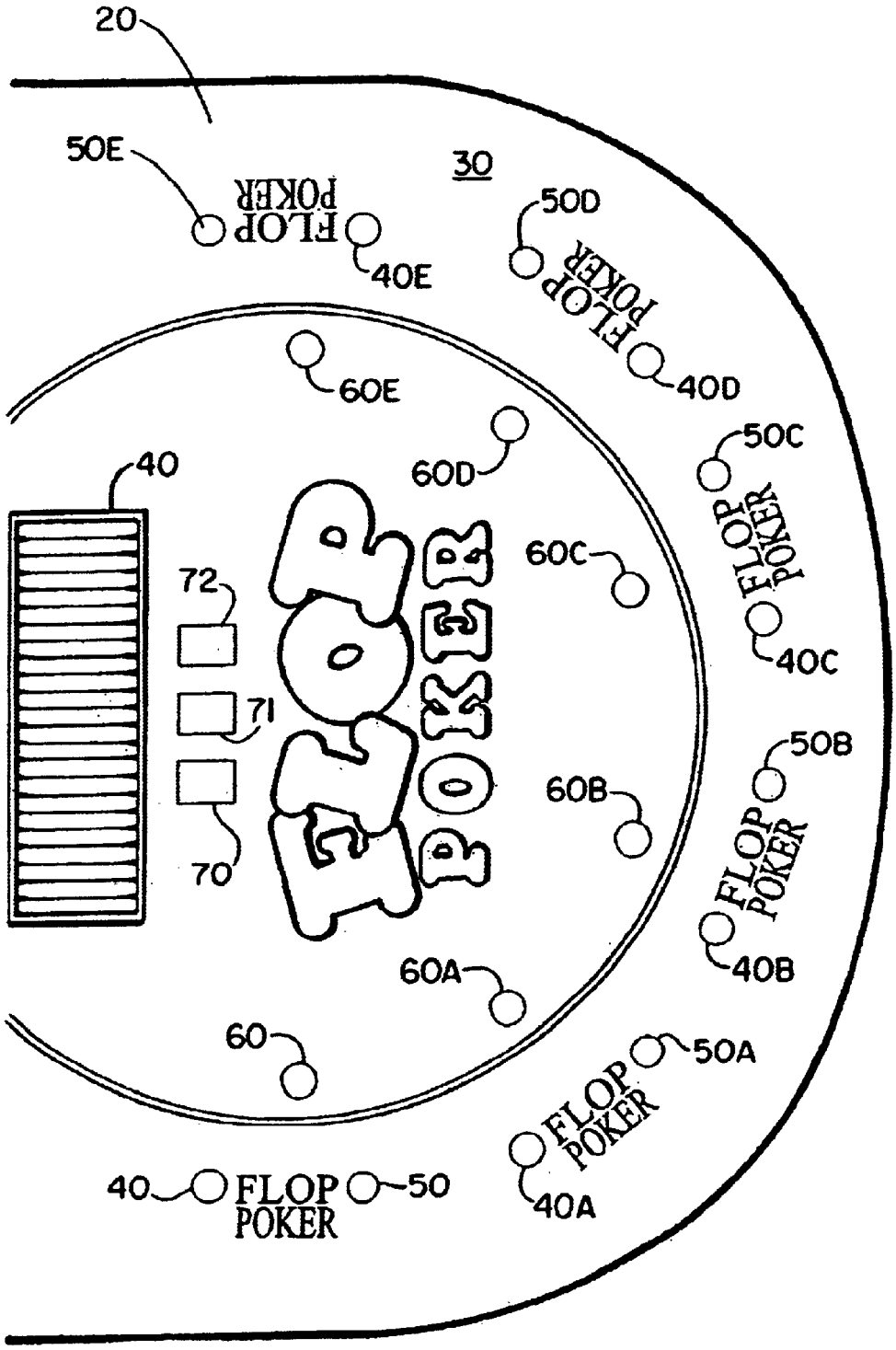
FIG. 1 is a top plan view of a preferred gaming table and layout.

Referring to FIG. 1, table 20 can be a two legged in a half-moon shape and have a flat playing surface 30. The actual form of such a table (whether semi-circular, square etc.) can vary, table 20 mainly serving to support the layout at a height which is suitable for the players. Area 40 is an area for housing the chips/counters prior to being used by the players. Surface 30 provides a playing surface marked with indicia 70–71 to define the areas wherein the community cards are positioned by the dealer. A second area on the layout designates betting areas for the reception of players' chips such betting areas bearing indicia in the form of circle symbols 40, 50, and 60, situated in front of each player. Symbol 40 identifies the area for an ante wager. Symbol 50 identifies the area for a flop wager. Symbol 60 identifies the area for a pot wager. The betting areas 40, 50, and 60 need not be stylized in the form of a circle and can be in the form of geometric shapes.

In Flop Poker the object of the game is twofold: 1) to make a good poker hand using three cards and two of the three community cards and 2) to win the Pot bets. In the case of 1) the house payment schedule lists a series of poker hands with corresponding pay-offs which apply to flop bet 50 and even pay-offs which apply to winning ante bets 40. In the case of 2), the player with the highest poker hand showing wins the combined Pot bets for all areas 60–60E. The Pot bet is a bet solely between the players and does not involve a wager against the house.

The Play

At the start of each game and prior to receiving cards all players place wagers, preferably in the form of chips, in their ante bet area 40–40E and also in their pot bet areas 60–60E.

The dealer shuffles the cards and places one card face down in the area on the layout marked 70 and deals each player one card face down. The dealer then places a second card face-down in the area marked 71 and deals the players a second card face-down, deals a third card face-down in the area marked 72, and concludes the round by dealing each player a third card facedown. The three cards in the areas 70–72 are community cards and can be used to complete each players' five card hand.

At this stage each player has the option continuing against the house by making a flop bet in their respective flop bet area 50–50E. When all wagers have been placed the dealer reveals the three community cards in areas 70–72. The players then reveal their cards. All bets are then settled.

Figure 2:
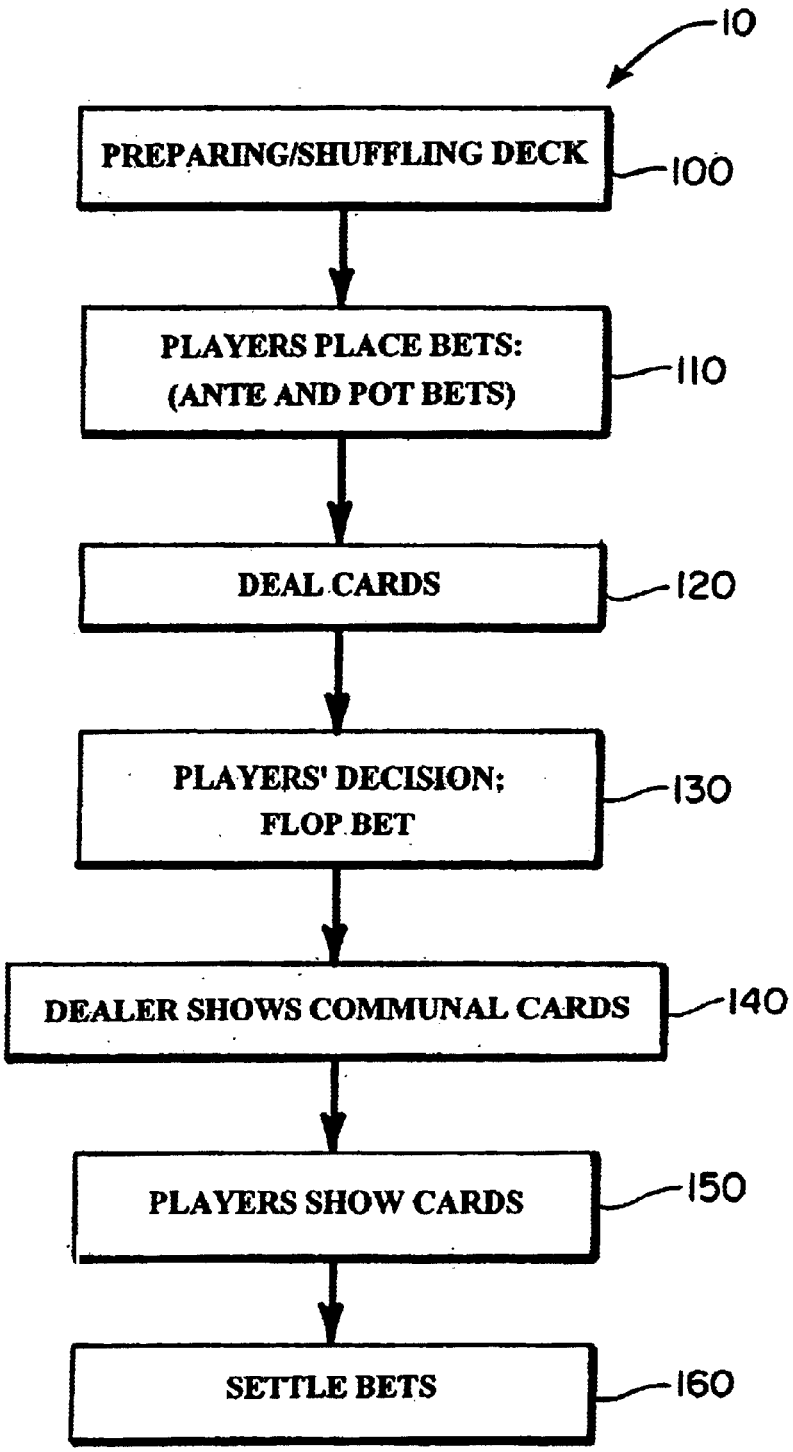
FIG. 2 is a schematic of a preferred method.

FIG. 2 illustrates a preferred embodiment of the method of the present invention. In step 100 the dealer preparing and shuffling the deck of cards 170. In at the start of each game in step 110 all players can place bets of equal value in their respective "Ante" positions 40–40E and also place bets of a equal value in their respective "Pot" positions 60–60E. "Ante" bets are against the house and pot bets are against other players.

In step 120 players can be dealt three cards each and the dealer receives three cards (all cards are face down). The three dealer's cards in positions 70–72 are community cards, referred to as the "flop" and can be used to complete each player's hand.

In step 130 the players at least know the identity of their respective three cards and have the option of continuing against the house and making a "Flop" bet based on the community cards in front of the dealer. If a player decides not to make a "Flop" bet, he quits the game against the house surrendering his "Ante" bet, but continues the game against the other players based on his original "Pot" bet. If all players decide to not make "Flop" bets, they will each surrender their respective "Ante" bets, but continue against the other players for the combined "Pot" bets.

In step 140 the dealer will reveal the three "flop" community cards in positions 70–72 and in step 150 each player reveals their cards. Now each player has the ability to use two of the three community cards to make the best five card hand. The player with the best five card hand wins all combined original "pot" bets and the bets are settled in step 160. In the event of players holding identical hands the combined "Pot" bets can be shared by the winning players.

In step 130, if a player decides to make a "flop" bet, he places his "flop" bet in his respective "flop" position 50–50E. This player is now playing against both the house and the other players. Against the house this player is placing both his "ante" bet and his "flop" bet. Against the other players this player is placing his "pot" bet. In step 140 the dealer will reveal the three "flop" community cards and in step 150 each player reveals their cards. In step 160 all bets are settled and each player has the ability to use two of the three community cards to make the best possible five card hand. No matter how many cards constitute community cards or how many cards are dealt to each player, the players select five cards to make up their hands. Each player who continued against the house by placing a "flop" bet, will have his best five card hand compared to the house table winning schedule corresponding pay-offs/odds. Each player having a losing hand against the house will forfeit his "ante" and "flop" bets respectively placed in positions 40–40E and 50–50E. Each player having a winning hand against the house will receive even money for that player's "ante" bet respectively placed in positions 40–40E and will receive pay table house odds for that player's "flop" bet respectively placed in positions 50–50E. Once all house wagers have been settled for each player, the Dealer can find the highest value five card poker hand among all players and award that player all combined original "pot" bets placed in positions 60–60E. In the event of players holding identical hands the combined "Pot" bets can be shared by the winning players.

The game Flop Poker is not limited to the above description/procedure with a deal relating to five cards per player. A variation of the deal consists in changing the mix of the number of cards dealt to the players and those that constitute the community cards. An example of a deal using seven cards and altering the mix of both the community cards and the players' cards would be where each player received three cards face-down, and the community cards (the Flop) would comprise four cards, one face-up and three face-down.

Referring to the preferred embodiment of the Flop Poker game, Table A illustrates the potential payoffs in relation to the list of poker rankings applicable to the game. The house advantage is achieved because a difference exists between the true mathematical odds and the actual pay-off ratios. Those of ordinary skill in the art can calculate appropriate poker rankings for a house advantage. The game can be played by offering odds/pay-offs of a higher or lower order resulting in different edges accruing to the house.

TABLE A

PAYOFFS

| Best Hand | Pay Table |
|---|---|
| Royal Flush | 1000 to 1 |
| Straight Flush | 500 to 1 |
| 4 of a kind | 100 to 1 |
| Full House | 30 to 1 |
| Flush | 20 to 1 |
| Straight | 10 to 1 |
| 3 of a Kind | 4 to 1 |
| 2 of a Kind | 2 to 1 |
| Jack's or Better | 1 to 1 |

Flop Poker can be adapted and played on a video game machine. Simulated cards are exposed electronically on a display panel/screen. Different rules for playing the game can be applied. In the above examples the pay-table can be adjusted to reflect the probabilities. It is to be understood that the embodiments discussed herein is merely illustrative of the application of the principles of the invention. Numerous modifications may be made therein and other arrangements may be devised without departing from the spirit and scope of the invention.

The following is a list of reference numerals:

LIST FOR REFERENCE NUMERALS

| (No.) | (Description) |
|---|---|
| 10 | method |
| 20 | table |
| 30 | surface of table |
| 40 | ante bet area |
| 50 | flop bet area |
| 60 | pot bet area |
| 70 | community card area |
| 71 | community card area |
| 72 | community card area |
| 100 | preparing/shuffling deck |
| 110 | placing of ante and pot wagers |
| 120 | dealing cards |
| 130 | decision regarding whether to place flop wager |
| 140 | dealer showing community cards |
| 150 | players showing cards |
| 160 | settling all bets |

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

What is claimed is:

1. A method of playing a card game comprising the steps of:

a) requiring each player to place an ante wager to participate in a wagering game played against a house/bank;

b) requiring each player to place an additional pot wager into a pot/pool; the pot constituting a communal wager or pool wherein the players compete not against the bank but against one another with the winner of the pot bets being the player holding the highest poker hand of five cards;

c) dealing a predetermined number of cards to each player face down;

d) dealing a predetermined number of communal cards face down;

e) based on the cards dealt in step "c" requiring each player to decide whether to place a flop wager to continue to participate in the wagering game played against the house/bank;

f) based on the cards dealt in steps "c" and "d" a comparison being made between each player's five card hand, such hand partly composed of individually dealt cards in conjunction with the communal cards, using poker rank both as the criterion for determining winning hands against the bank and for determining the winning hand regarding the pot bets;

g) for each player who placed a flop wager determining whether each such player has a winning hand against the house pay table and paying each winning player against the house even odds for the ante wager;

h) for each winning player in step "g" with respect to each player's flop wager paying each odds displayed by the house pay table depending upon the poker rank held by each winning player; and i) awarding all pot wagers to the player holding the highest poker ranked hand.

2. The method of claim 1, wherein the predetermined number of cards dealt to each player numbers three dealt face-down.

3. The method of claim 1, wherein the predetermined number of communal cards consist of three dealt face-down.

4. The method of claim 1, wherein the predetermined number of communal cards consist of two dealt facedown and one face-up.

5. The method of claim 1, wherein the predetermined number of cards dealt to each player numbers three, dealt face-down and wherein the number of communal cards consist of two, dealt face down.

6. The method of claim 1, wherein the amount of the ante wager is predetermined by house rules.

7. The method of claim 6, wherein the amount of the flop wager is predetermined by house rules.

8. The method of claim 1, wherein the amount of the pot wager is predetermined by house rules.

* * * * *